United States Patent [19]

Thomé

[11] Patent Number: 4,602,416

[45] Date of Patent: Jul. 29, 1986

[54] HIGH STRENGTH CRUSHING BAR AND A PROCESS FOR MANUFACTURING

[75] Inventor: Michel Thomé, Nouzonville, France

[73] Assignee: Societe Anonyme dite: Acieries Thome Cromback, Paris, France

[21] Appl. No.: 582,340

[22] Filed: Feb. 22, 1984

[30] Foreign Application Priority Data

Mar. 1, 1983 [FR] France ..... 83 03327

[51] Int. Cl.[4] ..... B02C 17/14; B22D 11/12

[52] U.S. Cl. ..... 29/527.5; 241/184

[58] Field of Search ..... 29/527.5; 241/184

[56] References Cited

U.S. PATENT DOCUMENTS 3,170,641 2/1965 Bard et al. ..... 241/184

*Primary Examiner*—Howard N. Goldberg
*Assistant Examiner*—Timothy V. Eley
*Attorney, Agent, or Firm*—Scully, Scott, Murphy & Presser

[57] ABSTRACT

The invention provides a ferrous metal crushing bar, coming directly from casting with controlled solidification, characterized in that it has a fine grain surface structure and a core with radially orientated dendritic structure, in that it comprises, in percent by weight, between about 1.1 and 3% of carbon, between about 3 and 30% of chromium, between about 0.3 and 1.5% of magnesium and between about 0.3 and 1% of silicon, and in that it comprises at least 10% by volume of carbides.

4 Claims, No Drawings

HIGH STRENGTH CRUSHING BAR AND A PROCESS FOR MANUFACTURING

BACKGROUND OF THE INVENTION

For crushing different products, a crushing technique is used in which the crushing bodies are long bars (80 mm in diameter and several meters in length), disposed substantially horizontally in a cylindrical crusher.

These crushing bars are used for fine or coarse crushing, dry or wet, and the products obtained may subsequently be treated in a ball mill.

Numerous products and processes have been tested as crushing bars, beginning with discarded laminated rails, simply cut to length and used as they are.

Crushing bars have been formed of materials rolled from a blank (ingot or billet), which orientates the fibers of the metal in the longitudinal direction, by hot deformation of the metal, under the pressure of a cylinder or a striking hammer. The fibers of the metal are normally orientated in the longitudinal direction of the bar (see for example U.S. Pat. No. 3 170 641).

In order to be easily rolled, the materials used to form the bars may be made from steel slightly alloyed with a carbon content less than or equal to 1.1% for, for example, an AISI 52100 or 1095 steel with more or less manganese.

The bars are rough rolled and straightened and, possibly, treated in accordance with processes which keep the bar straight (see, for example, U.S. Pat. No. 3,255,053). The treatment consists in austenization heating followed by cooling (quenching) so as to obtain a substantially martensitic structure from 50 to 60 RC. Bimetallic bars have also been used whose core is made from soft steel and whose surface is made from hard steel.

These materials can be rolled at a reasonable cost, and they are then alloyed with a limited carbon content. However, their wear rate is high, because of the limited amount of carbide.

SUMMARY OF THE INVENTION

The present invention provides crushing bars made from an alloyed material sufficiently charged with carbon to produce satisfactory wear resistance.

The invention also provides a process for manufacturing such bars without rolling the bars.

To this end, the invention relates to a crushing bar made from a ferrous metal, formed directly from casting with controlled solidification, and characterized in that it has a fine grain surface structure and a radially orientated dendritic inner structure. The bar comprises, in percentage by weight, between about 1.1 and 3% of carbon, between about 3 and 30% of chromium, between about 0.3 and 1.5% of manganese and between about 0.3 and 1% of silicon.

Depending on the applications contemplated for these bars, they may further contain, in percentage by weight, from 0 to 1% of copper, from 0 to 5% of nickel, from 0.1% of molybdenun, from 0 to 1% of titanium, from 0 to 0.5% of boron, from 0 to 2% of vandium and from 0 to 2% of tungsten.

These bars also will contain at least 10% by volume of carbides.

The invention also provides a process for manufacturing such a crushing bar characterized in that it is formed by continuously casting a ferrous metal of suitable composition, with controlled solidification, excluding any rolling phase.

With this process, contrary to the bars of the Prior Art, the crushing bars according to the present invention do not have fibers orientated in the longitudinal direction; that is, parallel to the axis of the bar.

A DETAILED DESCRIPTION OF THE PREFERRED EMBODIMENTS

As will be appreciated by those of ordinary skill in the art, to improve the wear and corrosion resistance of the crushing bar of this invention, the grain structure of the bar should gradually become more fine from the inner core of the bar toward the outside surface thereof. In fact, crushing bars are subjected to wear and corrosion from their surface, until they reach a certain diameter, where they are eliminated. It is then preferred that they to break into small pieces, rather than bend and interfere with the other adjacent bars. Thus, the internal structure of the bar should preferably be very coarse, and relatively breakable.

Crushing bars known in the art have two types of structure:

1. Rough rolling: perlitic structure, with an indentical grain throughout the cross-section of the bar.
2. Rolled with treatment: martensitic surface structure with fine grain; perlitic structure at the core with conservation of the initial rolling grain.

These known bars, made from a lightly alloyed steel, with a carbon content less than or equal to 1.1% are designed so as to have an external wear resistant layer and a soft and resilient internal core, so as to provide the best compromise between wear resistance and fragility. These bars do not have sufficient quenchability to be martensitic at the core, for a diameter from 8 to 100 mm.

The aim of the present invention is to provide a crushing bar whose characteristics are much to prior art bars. This is achieved by constructing the bars of a different material, and by forming the bars with a particular structure obtained by an original process.

As was pointed out above, such a crushing bar is made from a steel with a high carbon content and a high carbide percentage.

The following Table I shows various characteristics of different prior art crushing bars and of bars constructed in accordance with this invention.

TABLE 1

| Steel bars of type | Carbon content (% by weight) | Carbide content (% by volume) | Type of carbide | Micro hardness of the carbide (Vickers) | Average surface hardness (Rockwell RC) | Surface structure |
|---|---|---|---|---|---|---|
| 100 C 6 | 1,— | 1% | $M_3C$ | 700/900 | 45 | tampered martensite |
| 1095 or XC 95 | 0.95 | 1% | $M_3C$ | " | 32 | " |
| 50 M C4 quenched | 0.5 | 1% | $M_3C$ | " | 58 | " |
| 51 10 Q treated | 1.1 | 1% | $M_3C$ | " | 55 | " |

TABLE 1-continued

| Steel bars of type | Carbon content (% by weight) | Carbide content (% by volume) | Type of carbide | Micro hardness of the carbide (Vickers) | Average surface hardness (Rockwell RC) | Surface structure |
|---|---|---|---|---|---|---|
| Bars in accordance with the invention for example (1) | 1.5 | 10% | $M_7C_3$ | 1200 to 1800 | 40 | austenite and tempered martensite |
| (2) | 2 | 16% | $M_7C_3$ | depending on the direction of the carbides | 58 | |

The bar of the invention has on the surface, an homogeneous grain structure not orientated in the longitudinal direction of the bar; and it is not a rolled structure with drawing out of the fibers. With a carbon content greater than or equal to 1.2% by weight, this structure comprises a high percentage of carbide of the type $M_3C$, $M_7C_3$, $M_{23}C_6$, depending on the type of alloy, where M is designating an iron-alloy compound.

The internal structure of the bar of the invention is dendritic with an orientation perpendicular to the cylindrical surface of the bar. Thus, the hardness of the carbides orientated on this direction is greater than their lateral hardness, the micro hardness of the surface of the bar will remain high even after the diameter of the bar has been reduced by abrasion.

Furthermore, the radial dendrite structure ensures sufficient frangibility of the metal to cause it to break into pieces once the diameter of the bar has been reduced below a certain level.

The bar of the invention has then at the surface, over a certain thickness, a fine grain structure whereas its core has a radial dendritic structure.

Depending on the applications for which the bars will be used, different compositions may be chosen: austenitic, martensitic or bainitic, with hardnesses and varying carbide and matrix compositions.

Such a bar can only be produced by the process of the invention, which will now be described in greater detail.

A process must be used which is economical and which directly gives the bar of the invention, for it cannot be rolled economically. Furthermore, rolling, even costly, would destroy the structure favorable to the wear resistance characteristics.

The bar cannot be manufactured by sintered powder compaction because this is a costly process and gives a homogeneous structure in all directions without any particular advantage.

The bar of the invention is formed by continuous horizontal casting, with a final diameter of 50 to a 100 mm and with the required length from 2 to 6 m and more. Controlled solidification and the formation of the fine grain structure at the surface and the dendritic structure at the core are obtained by appropriate adjustment of the conditions for extracting the bar from the production ingot mold, either according to a pitch between 1 and 50 mm or a pitch-to-diameter ratio (length of the pitch related to the diameter of the bar) of 5/100 to 5/10).

After solidification, the bar is cooled in a controlled manner to obtain the desired matrix and morphology of the carbides. This cooling may be a heat cycle: a drop in temperature, then a temperature rise, followed by a level temperature stretch and then cooling. Thus, the process of the invention provides a product which can be used directly in ordinary crushers. In some particular cases, an additional or complementary heat treatment may be carried out.

Crushing bars that are subjected to particularly high impact forces in very high power crushers or in crushers with a large diameter, should have no or minimal surface defect, crack line, etc. These defects, well known in the state of the art, are generally related to the rolling process and to possible segregations due to the rough ingot or billet.

The bar of the invention does not have any defects of this sort. However, considering the alloy forming the bar and the process of manufacturing the bar, scales, surface reliefs or surface microsegregations may form on the product. To eliminate possible stress concentrations due to the forces and zones of potential premature breakage, regeneration of the of this surface of the bar may be carried out, if required, by one of the following methods.

It is already known to remove a surface layer by grinding and machining that surface material, but such a process is costly. According to the invention, it is preferable in use means which locally transform the surface to be regenerated—on hot or cold bar—by remelting, by plasma, laser or high frequency induction. Another solution may consist in crushing the small waves and the local surface segregations generated by the horizontal continuous casting. To do this, the surface may be shot-blasted or hammered by circular travelling devices.

In a preferred embodiment of the invention, the crushing bar is made from ferrous metal having the following analysis, in percent by weight:

carbon: 1.4 to 1.6%,
chromium: 11 to 12%,
molybdenum: 0.4 to 0.6%,
vanadium: 0.3 to 0.5%;
silicon: 0.5 to 0.7%,
mangenese: 0.5 to 0.8%.
balance iron or an iron alloy.

As will be understood by those in the art, the exact composition of the crushing bar depends, inter alia, on the nature of the material to be crushed, its humidity, and the type of crusher used.

This bar has generally a diameter of 80 mm and is obtained by horizontal continuous casting in a machine with controlled extraction parameter giving a pitch of 10 mm.

The bar is cooled in 30 minutes from a temperature of 1180° C. on leaving the ingot mold, to a temperature of 400° C. The bar is cut when hot to a length of 3.10 m.

Such a bar in accordance with the invention has a hardness of 40 RC. Its surface structure is austenitic and has a fine grain layer over a thickness of 5 mm. The core of the bar has a hardness of 32 RC and its structure is dendritic.

Such a bar, falling from a height of 4 mm onto a rigid support by its middle, does not break.

A batch of such bars was tested in a crusher of 2 m in diameter used for crushing uranium mineral.

The wear found by comparison with a surface treated steel was as follows (in microns per hour), during 2 successive measurements 1 and 2:

| | 1 | 2 |
|---|---|---|
| Steel bars | 20 | 21 |
| Bars of the invention | 12 | 13 |

The bars of the invention have then a wear resistance very much greater than the usual bars.

I claim:

1. A process for manufacturing a crushing bar, comprising the steps of:

continuously casting a metal rod comprising, by weight, between about 1.1 and 3% carbon, between about 3 and 30% chromium, between about 0.3 and 1.5% manganese and between 0.3 and 1% silicon, and further comprising at least 10% by volume of carbides; and solidifying the rod, without rolling the rod, said solidifying step including the steps of (i) forming an outside tubular portion of the rod with a homogeneous fine grain structure, and (ii) forming an inner core of the rod with a radially oriented dendritic structure.

2. A process according to claim 1, wherein the solidifying step includes the step of cooling the rod to form the fine grain structure in the outside tubular portion of the rod and the dendritic structure in the inner core of the rod.

3. A process according to claim 2 wherein the cooling step includes the steps of:

lowering the temperature of the rod;

then raising the temperature of the rod;

then holding the temperature of the rod level; and then again lowering the temperature of the rod.

4. A process according to claims 2 or 3 further comprising the step of regenerating the surface of the rod after the cooling step.

* * * * *